US005924562A

United States Patent [19]

Barth

[11] Patent Number: 5,924,562

[45] Date of Patent: Jul. 20, 1999

[54] ORAL HYGIENE SYSTEM

[76] Inventor: Dorothea A. Barth, 1427 Algonquin Dr., Schaumburg, Ill. 60193-4844

[21] Appl. No.: 09/127,567

[22] Filed: Jul. 31, 1998

[51] Int. Cl.[6] ..... A61B 19/02; A45D 33/32

[52] U.S. Cl. ..... 206/63.5; 132/288; 132/316; 206/229; 206/362; 206/581

[58] Field of Search ..... 206/581, 229, 206/369, 63.5, 362; 132/315, 316, 288, 308

[56] References Cited

U.S. PATENT DOCUMENTS

| | | | |
|---|---|---|---|
| 1,875,650 | 9/1932 | Pemberton et al. | 132/288 X |
| 4,269,206 | 5/1981 | Boyd | 132/288 |
| 4,384,649 | 5/1983 | Brodsky . | |
| 4,871,091 | 10/1989 | Preziosi . | |
| 4,972,946 | 11/1990 | Whittaker | 206/581 X |
| 4,995,519 | 2/1991 | Rose et al. . | |
| 5,011,018 | 4/1991 | Keffeler . | |
| 5,332,096 | 7/1994 | Battaglia . | |
| 5,348,153 | 9/1994 | Cole | 206/581 X |
| 5,361,947 | 11/1994 | Lifshey . | |
| 5,456,361 | 10/1995 | Walsh et al. | 206/63.5 X |

*Primary Examiner*—Bryon P. Gehman
*Attorney, Agent, or Firm*—Joseph N. Breaux

[57] ABSTRACT

An oral hygiene system is provided which includes a decorative hinged plastic storage case for containing all the components of the oral hygiene system which include a small portable dispensing case with a hinged top with a mirror located on the inside surface of the hinged top, a small illumination device located on the inside portion of the hinged top adjacent to the mirror, a number of saturated mouthwash pads each individually wrapped and contained within the small portable dispensing case, a number of refillable clear zip-lock disposal bags providing a location for disposing of used mouthwash saturated pads when needed.

4 Claims, 2 Drawing Sheets

ORAL HYGIENE SYSTEM

TECHNICAL FIELD

The present invention relates to devices and methods for oral hygiene and more particularly to devices and methods for a portable oral hygiene system for maintaining oral hygiene which includes a small fold out mirror assembly and a number of disposal flexible wipe members each individually packaged and saturated with disinfectant type mouthwash.

BACKGROUND ART

There are numerous occasions when a person is in need of oral hygiene but is not in a location where normal oral hygiene may be carried out. These situations usually occur in one's vehicle, while traveling, while at meetings or other social events which may require impromptu oral hygiene. Prior to the present invention there has never been a kit and method for conducting oral hygiene as set forth herein which provides a very efficient and handy method and kit. The present invention includes a portable travel case with a fold out mirror assembly and numerous disposal flexible wipe members each of which is packaged and saturated with disinfectant type mouthwash, wherein the disposal flexible wipe members help remove plaque and to perform other oral hygiene procedures. Sealable plastic bags are also provided in the present invention for disposing of the used mouthwash wipes when desired and a decorative storage box for storing all components of the oral hygiene kit.

The relevant patents regarding this area of technology are as follows:

Lifshey U.S. Pat. No. 5,361,947 which discloses a single use fluid dispensing device.

Battaglia U.S. Pat. No. 5,332,096 which discloses a mouthwash capsule and package apparatus.

Kesseler U.S. Pat. No. 5,011,018 which discloses a medication dispenser which removable liner.

Rose et al U.S. Pat. No. 4,995,519 which discloses ampoules.

Preziosi U.S. Pat. No. 4,871,091 which discloses a disposal package for liquids.

Brodsky U.S. Pat. No. 4,384,649 which discloses a dispensing package.

As can be seen from the several patents there has never been an oral hygiene system as the present which provides an efficient and quick means of conducting oral hygiene while a person is in an inconvenient location. The present invention provides an oral hygiene system with hygiene wipes provided in a portable dispensing container which wipes are saturated with a disinfectant oral hygiene composition and which kit includes a disposal plastic bag for used oral hygiene wipes as needed.

GENERAL SUMMARY DISCUSSION OF INVENTION

It is thus an object of the invention to provide a Oral Hygiene System that allows a user to conduct oral hygiene procedures while in locations which would not accommodate normal oral hygiene procedures.

It is a further object of the invention to provide a Oral Hygiene System that allows a user to conduct oral hygiene at locations such as meetings, social events, in one's vehicle, or in any other inconvenient location not suitable for conducting normal oral hygiene procedures such as brushing one's teeth or rinsing with mouth wash.

It is a still further object of the invention to provide a Oral Hygiene System that includes a means for maintaining proper oral hygiene that comprises a portable dispensing case with a small fold out mirror assembly on an inside surface of the portable dispensing case hinged lid and a number of disposal flexible wipes each individually packaged and saturated with disinfectant type mouthwash which are stored in the portable dispensing container.

Accordingly, a Oral Hygiene System is provided which comprises a portable dispensing case while a small fold out mirror assembly is contained within a top hinged portion of a portable case and wherein the number of disposable flexible wipe members are each individually packaged and saturated with disinfectant type mouthwash and stored within the portable dispensing case while a number of disposal plastic bags are provided for disposing of the used mouthwash wipes when desired, further wherein a small illumination source is provided adjacent to the mirror to illuminate an interior of the mouth of the user while the wipes are used to remove plaque and conduct other oral hygiene procedures.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that a person who desires to clean his or her teeth and freshen his or her breath when brushing or rinsing with mouth wash is not convenient would simply open the portable dispensing case of the oral hygiene system, remove one of the disposable mouthwash saturated pads and quickly wipe his or her teeth clean. The user would have a handy mirror which is attached to an inside surface of the hinged top on the portable dispensing case. Furthermore, a small illumination device is mounted adjacent to the mirror for illuminating portions of the mouth when using the wipe. The used wipe would then be placed within a resealable clear zip-lock type disposable bag for disposal at a later time. The small portable dispensing case, mouthwash saturated pads, and refillable clear zip-lock disposal bags are all stored in a hinged plastic case for night stand or shelf storage. The oral hygiene system provides a handy method of always being able to perform oral hygiene no matter where the user may be located.

Figure 1:
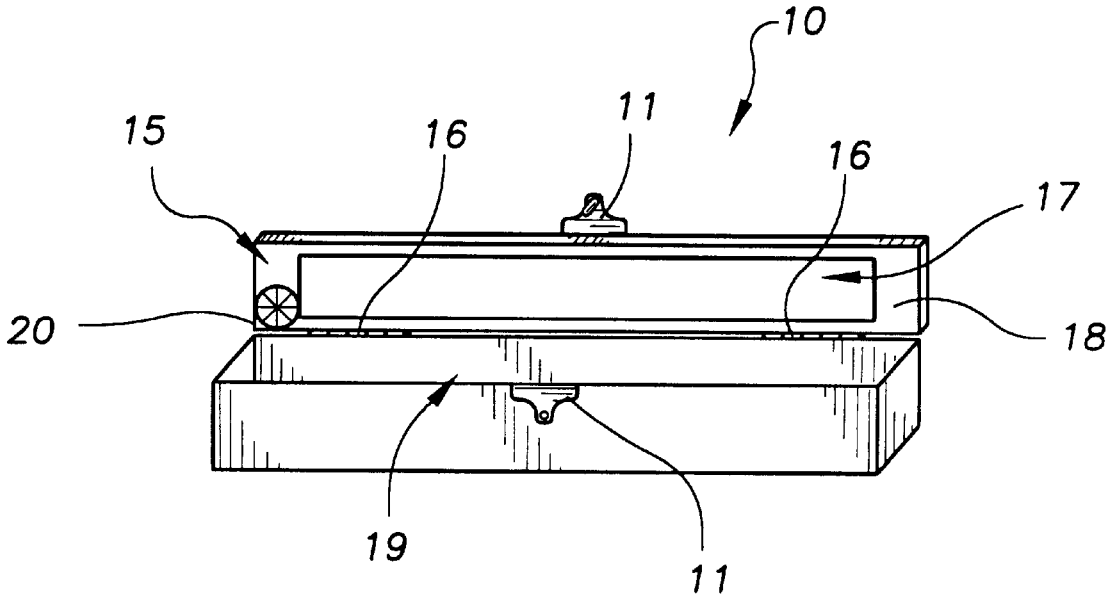
FIG. 1 is an isometric view of a portable dispensing case for the oral hygiene system illustrating the location of the fold out mirror on an inside surface of the hinged lid.
Figure 2:
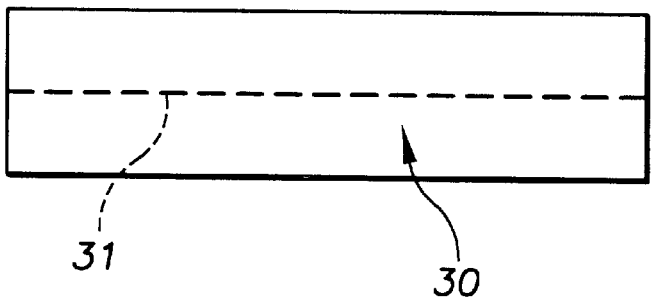
FIG. 2 is a plain view of a mouthwash saturated pad which is dimensioned to be received in portable dispensing case.

Referring to the figures in detail, FIG. 1 illustrates a portable dispensing case 10 which is substantially rectangular in shape and includes a hinged top 15 attached to the storage compartment by hinge 16 and includes a small inspection mirror 17 attached to an inside surface 18 of the hinged top 15. The portable dispensing case 10 includes an interior portion 19 which is dimensioned to receive mouthwash saturated pads 30. The portable travel case 10 is preferably constructed of plastic and is also preferably provided with a decorative outside surface and includes a snap latch 11 which secures the hinged lid 15 when closed. The hinged top 15 may also include a small illumination device 20 which is preferably a battery powered light bulb which illuminates when the hinged top is opened to its full open position. The illumination device includes a switch which is activated by the motion of the hinge on the hinged top. Replaceable batteries for powering the light are placed in the hinged lid behind the inspection mirror.

The mouthwash saturated pads 30 are stacked within the interior 19 of the portable travel case 10. The saturated mouthwash pads 30 are preferably individually sealed to assure the cleanliness and longevity of the mouthwash saturated pads. The mouthwash saturated pads 30 are preferably constructed of a durable cotton material similar to material used to construct Baby Wipes™ or other saturated pads for use in hand washing and/or baby clean up. The saturated pads 30 include a longitudinal perforated line 31 which extends the length of the saturated pad and provides a folding location for the saturated pads so that the saturated pads can be fit easily within the interior 19 of the portable travel case 10.

Figure 4:
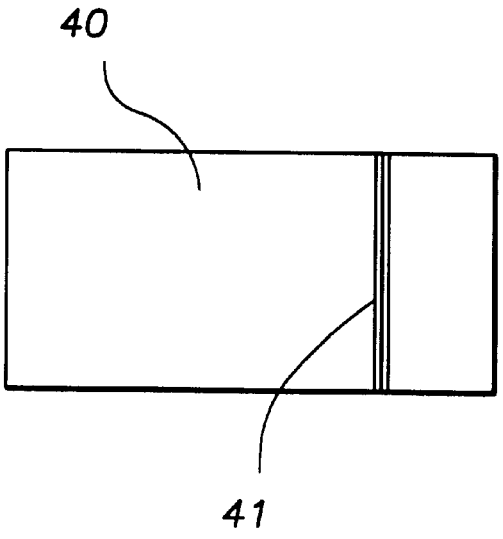
FIG. 4 is a plain view of a resealable clear zip-lock type disposal bag for disposing of used mouthwash pads.

A refillable clear zip-lock disposable bag 40 is illustrated in FIG. 4 and is provided with the oral hygiene system for disposing of used saturated mouthwash pads. The clear zip-lock disposal bags 40 include a zip-lock end 41 which allows for easy access to an interior of the zip-lock bag and a means for securing sealing the zip-lock bag so the used saturated mouthwash pads do not spill from the disposable bag 40.

Figure 3:
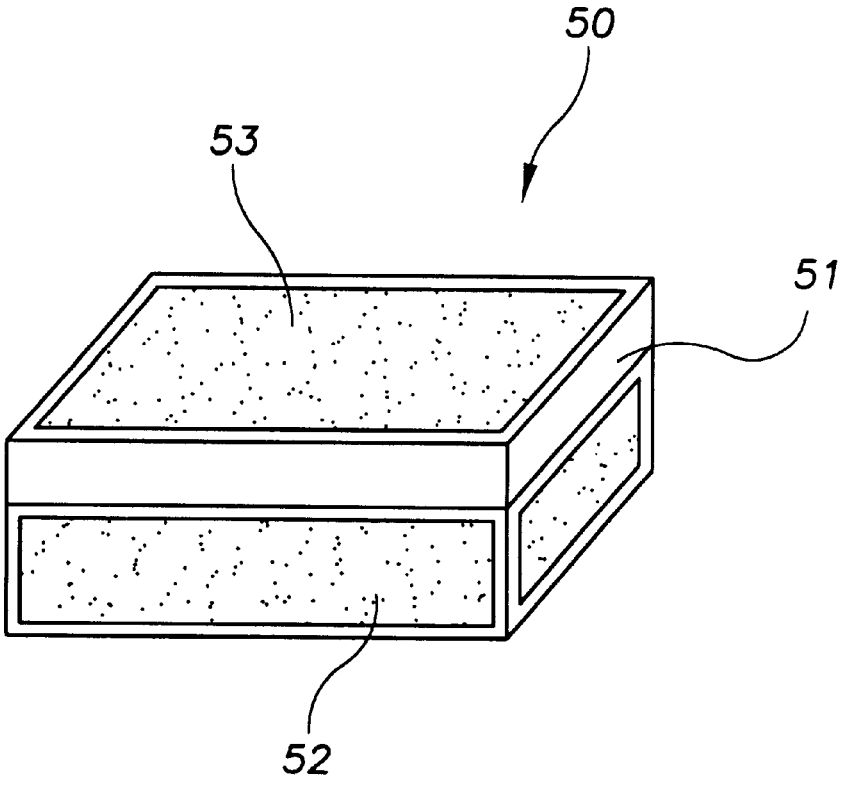
FIG. 3 is a hinged plastic case for night stand or shelf storage of all components of the oral hygiene system.

FIG. 3 illustrates a hinged plastic case 50 for containing all the elements of the oral hygiene system. The hinged plastic case 50 includes a hinged top 51 and a main storage compartment 52. Additionally, the hinged top of the case is preferably provided with a decorative outside surface 53 so that the case can be placed in locations visible to the user and other persons.

The saturated mouthwash pads 30 are preferably saturated with a mouthwash chemical composition which assists in prevent or removing plaque from the users teeth and also assists in removing bad breath as well as performing other oral hygiene procedures when the saturated mouthwash pad is rubbed on the teeth by the user. The saturated mouth wash pads are also preferable stored in a moisture impermeable wrapper to prevent the pads from drying out over time.

It is noted that the embodiment of the Oral Hygiene System described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An oral hygiene system comprising:

a) a decorative hinged top storage container for storing all components of a oral hygiene kit, wherein the storage container includes a decorative outer surface, b) a small portable dispensing case which fits within the decorative hinged top storage container, wherein the portable dispensing case is rectangular in shape, has a hinged top and has an interior for storing mouthwash saturated oral hygiene pads, the hinged top includes an interior surface with a mirror mounted on the interior surface and an illumination device including a mouth illuminating light mounted in the hinged top interior surface adjacent to the mirror wherein the light is activated when the top is opened and deactivated when the top is closed, c) numerous mouthwash saturated oral hygiene pads each individually wrapped in moisture impermeable plastic and stored in the interior of the portable dispensing case, d) a number of zip-lock plastic disposal bags for disposing of used oral hygiene pads.

2. The oral hygiene system of claim 1, wherein said mouthwash saturated pads further comprise pads which are saturated with a mouthwash composition which helps prevent plaque and bad breath.

3. The oral hygiene system of claim 1, wherein the portable dispensing case further comprises a hinged top which is secured in a closed position with a snap latch.

4. The oral hygiene system of claim 1 wherein the mouth illuminating light further comprises a battery powered mouth illuminating light.

* * * * *